US006855392B2

(12) United States Patent
Wildeman et al.

(10) Patent No.: US 6,855,392 B2
(45) Date of Patent: Feb. 15, 2005

(54) PATTERNED STITCH BONDED PILE FABRIC

(75) Inventors: Martin Wildeman, Spartanburg, SC (US); Robert Fontaine, Spartanburg, SC (US)

(73) Assignee: Tietex International, Ltd., Spartanburg, SC (US)

( * ) Notice: Subject to any disclaimer, the term of this patent is extended or adjusted under 35 U.S.C. 154(b) by 151 days.

(21) Appl. No.: 10/317,646

(22) Filed: Dec. 12, 2002

(65) Prior Publication Data

US 2004/0115388 A1 Jun. 17, 2004

(51) Int. Cl.[7] ..... B32B 3/02; B32B 33/00; D04H 3/05; D04H 1/54

(52) U.S. Cl. ..... 428/88; 428/89; 428/95; 442/366; 442/401; 442/402; 442/409; 442/411; 442/415; 66/190; 66/191; 112/410; 28/159; 28/160

(58) Field of Search ..... 428/85, 88, 89, 428/95; 442/366, 401, 402, 409, 411, 415; 66/190, 191; 112/410; 28/159, 160

(56) References Cited

U.S. PATENT DOCUMENTS

| | | | | |
|---|---|---|---|---|
| 6,423,393 | B1 * | 7/2002 | Wildeman | 428/91 |
| 6,521,554 | B1 * | 2/2003 | Wildeman | 442/366 |
| 2003/0070739 | A1 * | 4/2003 | Zafiroglu et al. | 156/93 |
| 2003/0220038 | A1 * | 11/2003 | Tsiarkezos | 442/327 |

* cited by examiner

*Primary Examiner*—Cheryl A. Juska
*Assistant Examiner*—Jenna-Leigh Befumo
(74) *Attorney, Agent, or Firm*—J. M. Robertson Intellectual Property, LLC

(57) ABSTRACT

A patterned pile fabric of stitch-bonded construction. The fabric includes a substrate layer with an arrangement of ground yarns extending in stitched relation through the substrate layer so as to define a ground covering across the substrate layer. An arrangement of pile forming yarns extend in stitched relation through the substrate layer such that the pile forming yarns define a patterned arrangement of looped elements projecting away from the ground covering in predefined three dimensional patterned arrays disposed across the fabric.

23 Claims, 4 Drawing Sheets

PATTERNED STITCH BONDED PILE FABRIC

TECHNICAL FIELD

The present invention relates to stitch bonded materials and more particularly to stitch bonded materials having a multi-yarn stitch system incorporating yarns stitched through a fibrous substrate so as to define a pattern of raised and lowered pile surfaces across the fabric.

BACKGROUND OF THE INVENTION

Pile fabrics in general are well known and typically include a plurality of pile yarns tufted through or bonded to a substrate such as a scrim layer. By way of example only, one prior known technique for forming a pile fabric has been to pass pile yarns back and forth between opposing substrate layers so as to form a coordinated structure and to thereafter slit the formed structure between the substrate layers so as to yield a free-standing pile surface extending away from each of the substrate layers. Patterning across the pile surface may thereafter be carried out by various means including shaving, impingement by hot air so as to selectively melt outstanding pile yarns in a desired pattern, chemical degradation in a desired pattern using acid etching or the like, and impingement by high pressure water streams so as to dislodge and/or reorient pile fibers in a desired pattern. While such techniques have been useful, they have nonetheless been relatively complex and difficult to carry out due to the need to use specialized equipment to carry out the patterning procedures.

Fabric formation using so-called stitch bonding techniques is well known. Such techniques include so-called Mailiwatt and Liba processes. In such processes, a multiplicity of stitching yarns is passed repeatedly in stitching relation through a substrate in closely spaced rows so as to form a coordinated arrangement of surface stitches in covering relation to the substrate. While it has been possible to use such stitch bonding techniques to form substantially uniform pile surfaces, it is not believed that structures using multiple yarn systems to impart intricate patterns of raised and lowered surfaces has been used in the past.

SUMMARY OF THE INVENTION

The present invention provides advantages and alternatives over the prior art by providing a method for forming a patterned pile fabric directly on a stitch bonding machine wherein intricate designs may be produced using a ground yarn system in combination with a pile yarn system without the need for substantial subsequent patterning processes. The resulting pile fabrics may find uses in any number of applications including residential and/or automotive upholstery wherein substantial fabric integrity is required.

BRIEF DESCRIPTION OF THE DRAWINGS

The accompanying drawings which are incorporated in and which constitute a part of this specification illustrate several exemplary constructions and procedures in accordance with the present invention and, together with the general description of the invention given above and the detailed description set forth below, serve to explain the principles of the invention wherein.

DESCRIPTION OF THE PREFERRED EMBODIMENT

Figure 1:
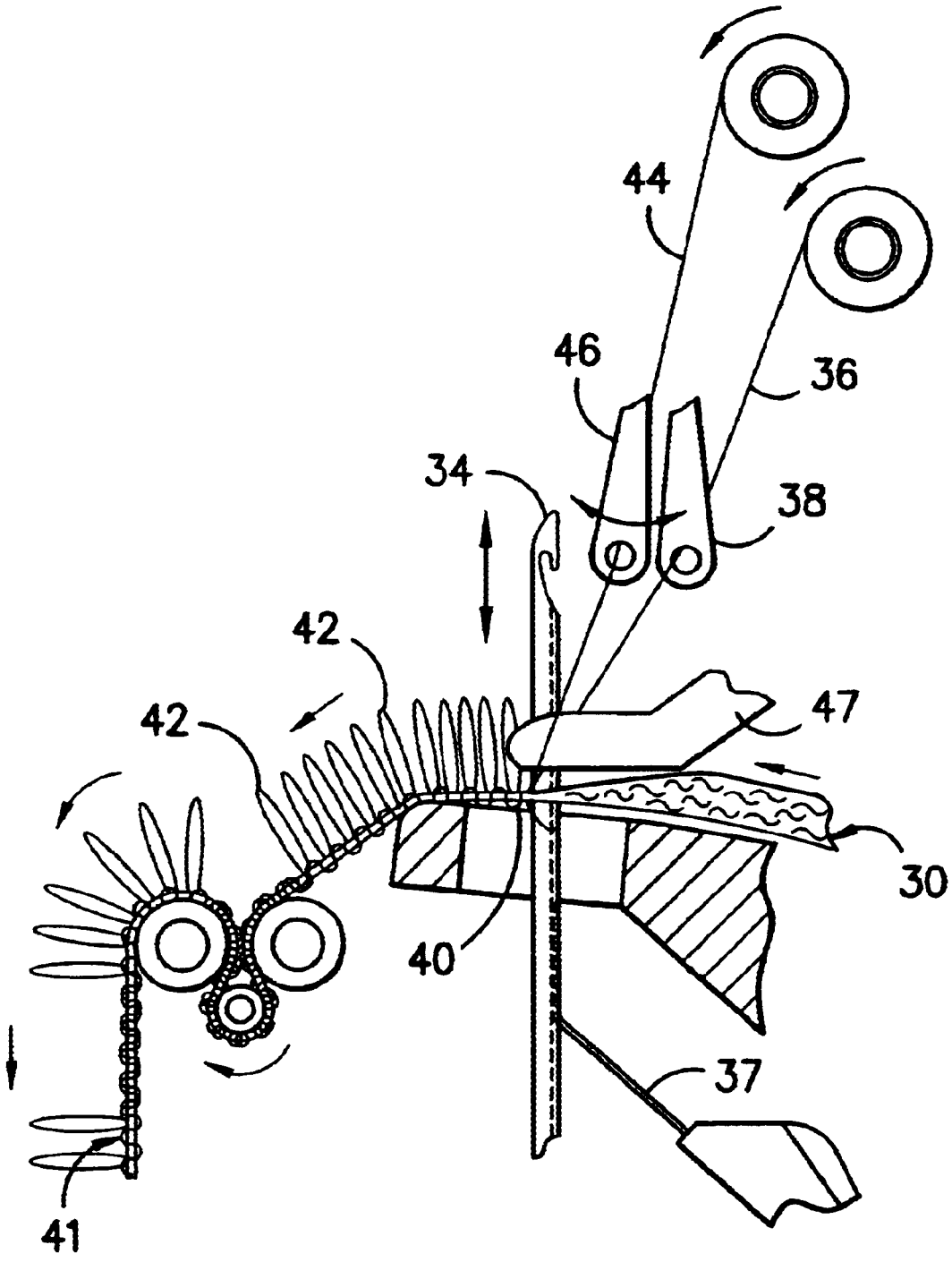
FIG. 1 illustrates schematically a two bar stitch bonding process for selectively forming a patterned surface yarn system and a cooperating ground yarn system through a fibrous substrate.
Figure 2:
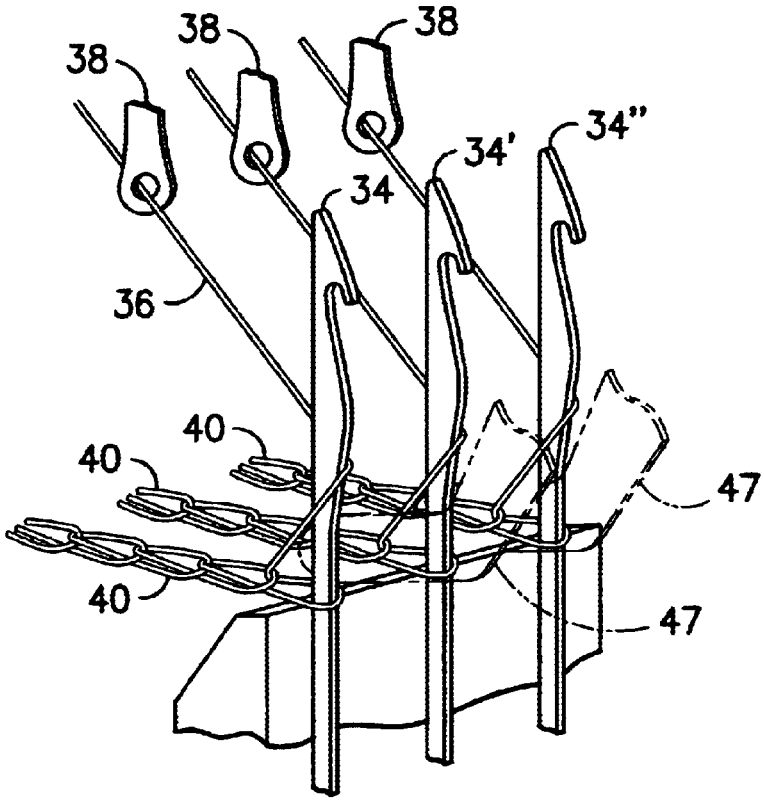
FIG. 2 illustrates schematically the stitching of a ground yarn in an arrangement of substantially flat chain stitches by a multiplicity of reciprocating needles.

Turning now to the drawings, a method as utilized to form a patterned pile material of stitch bonded construction is illustrated schematically in FIG. 1. In the illustrated practice, a substrate material 30 such as a carded and cross-lapped fleece or a needle punched or spun bonded fleece is conveyed to a stitch-forming position in the direction indicated by the arrow. If desired, the substrate material 30 may include a percentage of low melting point fibers such as low melting point polyester or bicomponent polyester having a core of relatively high melting point material and a sheath of lower melting point polyester to facilitate heat activated point bonding so as to enhance structural integrity.

As illustrated through simultaneous reference to FIGS. 1, 2, 3A and 3B, the stitch forming position is defined by a row of reciprocating needles 34, 34', 34" etc. extending in adjacent relation to one another across the width of the substrate material 30 substantially transverse to the direction of movement of the substrate material 30. As will be appreciated, while only three needles have been illustrated, in actual practice a large number of such needles are arranged in close relation to one another in the cross machine direction between the fingers 47 of a sinker bar. By way of example only, and not limitation, it is contemplated that the so called gauge or needle density in the cross machine direction may be in the range of about 28 needles per inch, although higher or lower needle densities may likewise be utilized if desired.

According to the illustrated and potentially preferred practice, at least two yarns systems are used to form stitches through the substrate material 30. In the practice of the present invention, a ground yam 36 (FIG. 2) is carried through a first set of moveable yarn guides 38 carried by a first guide bar (not shown) for cooperative substantially fully threaded engagement with the needles 34, 34', 34" etc. across the width of the substrate material 30. For ease of reference, the substrate material 30 is not illustrated in FIG. 2.

As will be appreciated by those of skill in the art, in operation the ground yarn 36 is moved into engagement with the needles which, in turn, carry the ground yarn 36 in a reciprocating manner through the substrate material 30 without engaging finger elements 47 of the sinker bar so as to form an arrangement of cooperating ground yarn stitches 40 extending in relatively closely spaced rows along the substrate material 30. By way of example only, and not limitation, the cooperating ground yarn stitches 40 may be held in a full chain stitch configuration although other stitch arrangements including tricot stitches and the like may likewise be utilized if desired. Preferably, the spacing of the stitch lines formed by the ground yarn 36 will be close enough that the ground yarn stitches 40 define a substantially continuous covering across the technical back 41 of the substrate material 30. The ground yarn 36 and the substrate material 30 thus define a substantially stable stitch bonded structure.

In order to impart controlled pile patterning to the fabric of the present invention, an arrangement of loop elements 42 is selectively formed projecting away from and standing above the ground yarn stitches 40 in a predefined pattern across the technical back 41 of the fabric. According to the preferred practice of the present invention, the loop elements 42 are formed substantially concurrently with the formation of the ground yarn stitches 40 through the substrate material 30. It is contemplated that such selective formation of loop elements may be carried out by several different techniques.

Figure 3A:
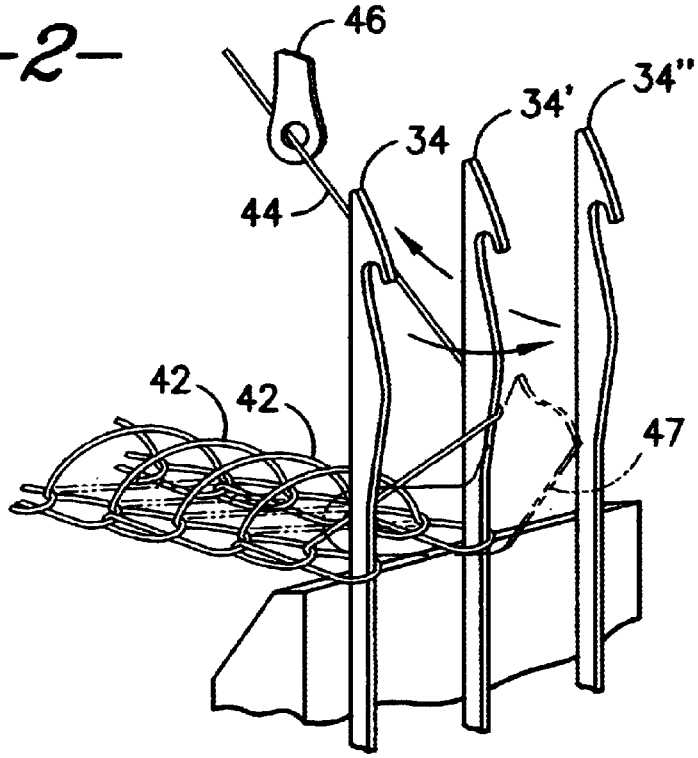
FIG. 3A illustrates schematically the stitching of a surface yarn in a pattern of loops by a first pair of cooperating reciprocating needles.
Figure 3B:
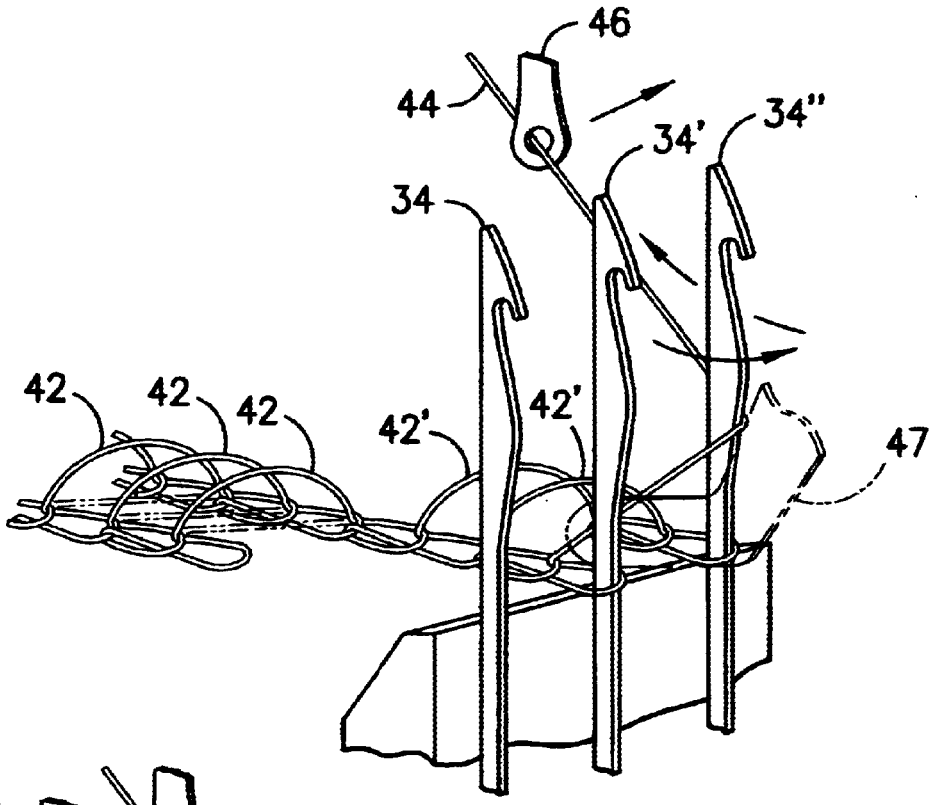
FIG. 3B illustrates schematically the stitching of the surface yarn of FIG. 3A in a pattern of loops by a second pair of cooperating reciprocating needles after the surface yarn is shifted laterally one needle.

A first technique for forming a pattern of loop elements 42 is illustrated in FIGS. 3A and 3B wherein the substrate material 30 and ground yarn 36 have been eliminated for ease of reference. According to this practice, loop elements 42 may be formed in a pattern by a pile yarn 44 threaded through moveable yarn guides 46 carried by a guide bar (not shown). As illustrated, in this practice the pile yarn 44 is only partially threaded relative to the needles. That is, at least a portion of the needles are free from engagement by the pile yarn. While only a single pile yarn 44 is illustrated for explanatory purposes, it is to be understood that in actual practice, multiple pile yarns 44 are used across the width of the fabric threaded in a pattern relative to the needles to impart a desired patterned arrangement.

As best illustrated in FIG. 3A, during an initial stage of an exemplary patterning process, the pile yarn 44 is carried in alternating fashion back and forth between a first pair of needles 34, 34' thereby forming a row of loop elements 42 as the pile yarn 44 is carried over the sinker finger 47 between the needles 34, 34' during stitch formation. Of course, if no sinker finger is used, the loop elements 42 are replaced by substantially flat crossing yarn segments which are illustrated by phantom lines immediately below the loop elements 42. As will be appreciated, as long as the pile yarn passes between the needles 34, 34' in a regular stitch forming procedure, a substantially continuous arrangement of loop elements 42 (or flat yarn segments) will be formed along the length of the fabric.

The present invention contemplates that the continuous formation of yarn structures may be interrupted and/or altered in a predefined manner so as to impart desired patterning in both the length and the width dimensions of the fabric. According to a first practice illustrated in FIG. 3B, it is contemplated that during fabric formation the pile yarn 44 may be moved laterally or "shogged" over at least one needle by the yarn guide 46 so as to be carried back and forth between a second set of needles 34', 34" for some period after such lateral movement. As will be appreciated, the result of such lateral movement is that the pile yarn 44 is shifted over to an adjacent position relative to the previously formed yarn structures. Once this yarn shift has occurred, formation of an arrangement of loop elements 42' or other patterning yarn structures may take place along a line laterally removed from the preceding yarn structures. Of course, the pile yarn 44 may be moved laterally numerous times in virtually any pattern desired. Moreover, since the yarn shift is repeated across the fabric, a repeating pattern may be formed along the fabric.

By way of example only, in the practice illustrated in FIGS. 3A and 3B, the yarn shift is accompanied by a so called "end out" arrangement such that the needle 34 no longer engages a pile yarn after the yarn shift takes place. Thus, the yarn shift is accompanied by a break in the formation of patterning yarn structures at the needle 34. Accordingly, in such a practice the pile yarn 44 is present only at discrete positions across the fabric thereby leaving voids with just a surface covering of base yarn stitches 40 between those areas. Of course, it is also contemplated that once shogging has occurred a new yarn may be brought into engagement with the needle 34 in which case the needle 34 may continue to make either looped or flat stitches.

Aside from the use of lateral yarn shift in combination with an end out construction to impart patterning, it is also contemplated that the lateral yarn shift may be carried out in combination with alterations in patterning at the needles. That is, the pile yarn may be handled differently at the needles before and after the yarn shift takes place. By way of example only and not limitation, it is contemplated that the patterning carried out by the needles may be such that upstanding loop elements are formed prior to the yarn shift with such loop elements being discontinued and replaced by flat yarn structures at the shifted position. As will be appreciated, such an arrangement may be achieved by simply eliminating the sinker finger 47 at the shifted location. Of course, this pattern can also be reversed if desired.

It is likewise contemplated that stitch structures may be altered during fabric formation such that the stitches themselves prevent or permit the formation of loop elements. By way of example only, it is contemplated that either before or after a yarn shift has taken place the pile yarn may be held for an extended period of formation in operative relation to a single needle so as to form a chain stitch or other flat stitch structure in the machine direction during such period. As will be appreciated, such cessation in the formation of loops for a period of time during fabric formation gives rise to a horizontal break in the cross machine direction. Of course, patterning control at the needles may also be carried out in combination with an end out construction to permit further freedom in the development of complex patterns.

By way of example only, it is contemplated that block elements may be formed by forming loop elements along a first set of needle lines for a predefined period of time and thereafter shifting to an adjacent set of needle lines for some predefined period of time before moving back to the initial set of needle lines. If the pile yarn 44 is shogged over to adjacent needles in a substantially progressive step-wise manner, a diagonal pattern of loop elements may be formed. Thereafter, progressively shogging back to the initial needle position gives rise to zigzag pattern.

In combination with the establishment of patterning in the machine direction, horizontal (i.e. cross-machine direction) breaks in patterns may be established by forming flat stitches at the threaded needles for a pre-established period between periods of loop formation. Likewise, longitudinal (i.e. machine direction) breaks may be established by use of end-out threading arrangements along predefined needle lines and/or by forming flat stitches along selected needle lines either continuously or for selected periods of time during fabric formation. Thus, by combining these techniques a wide array of surface patterns may be formed.

Figure 4:
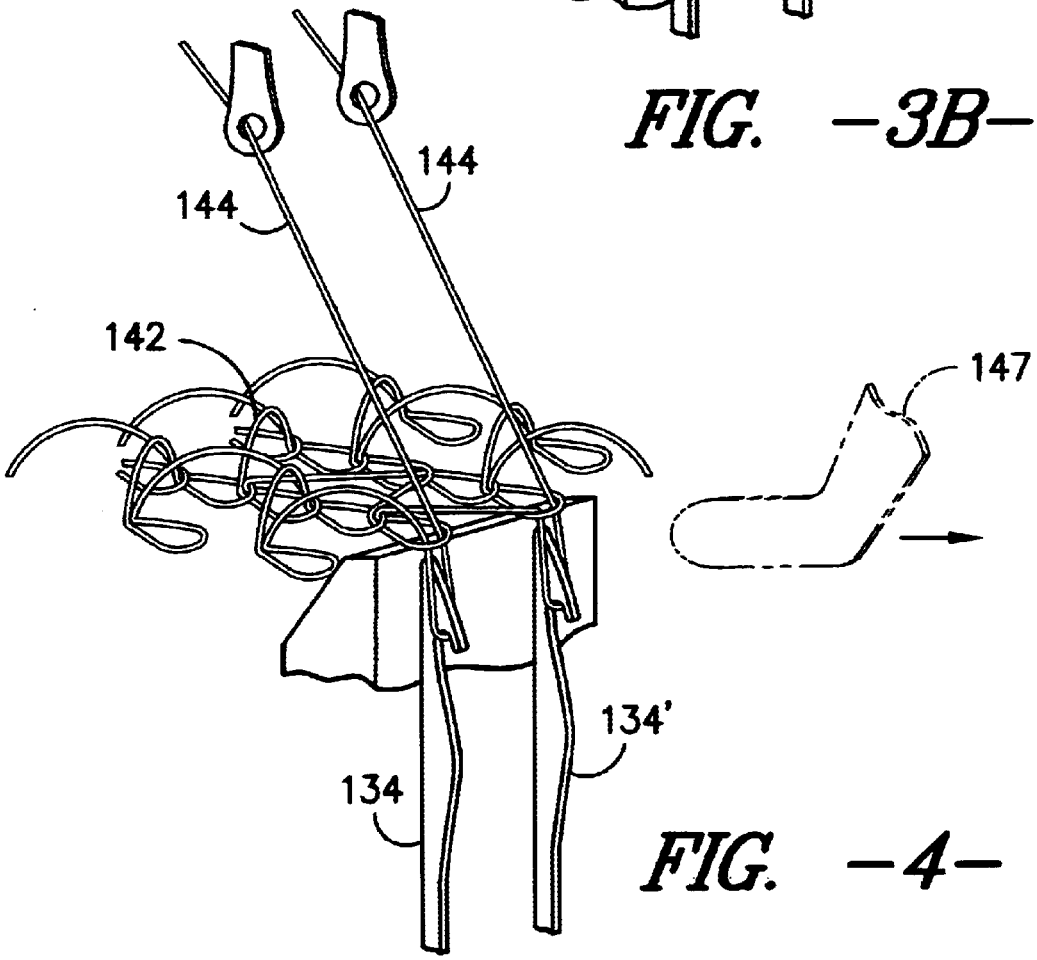
FIG. 4 illustrates schematically an alternative process for forming a pattern of loops using a pair of cooperating reciprocating needles in a fully threaded arrangement with a selectively displaceable sinker finger.

It is also contemplated that other mechanisms may be utilized to impart desired patterning in a stitch bonding procedure. By way of example only, in FIG. 4 there is illustrated schematically the selective withdrawal (or shifting) of a sinker finger 147 during the stitching of pile yarns 144 in a fully threaded arrangement. As may be seen, the withdrawal of the sinker finger 147 causes the formation of loop elements 142 to be discontinued and replaced by substantially flat (i. e. non-protruding) yarn structures in the region between the needles 134, 134' where the sinker finger was previously located. Of course, the sinker finger 147 may also be shifted laterally and reinserted at another location if desired.

As regards the materials of construction, the ground yarns 36 are preferably continuous multi-filament yarns of polyester, nylon or like material. Single ply multi-filament yarns of polyester having a linear density of about 70 denier may be particularly preferred although other materials and different linear densities may likewise be used if desired. The pile yarns 44, 144 are preferably textured continuous multi-filament yarns formed of materials such as polyester or nylon. Single ply multi-filament yarns of textured polyester having linear densities in the range of about 150 denier may be particularly preferred. However, multi-ply filament yarns and spun yarns may likewise be utilized. Moreover, it is contemplated that a wide range of linear densities between about 75 denier and 1500 denier may be utilized incorporating single ply filament, multi-ply filament or spun yarn systems as well as combinations thereof.

The invention may be further understood by reference to the following nonlimiting examples:

EXAMPLE 1

Figure 5:
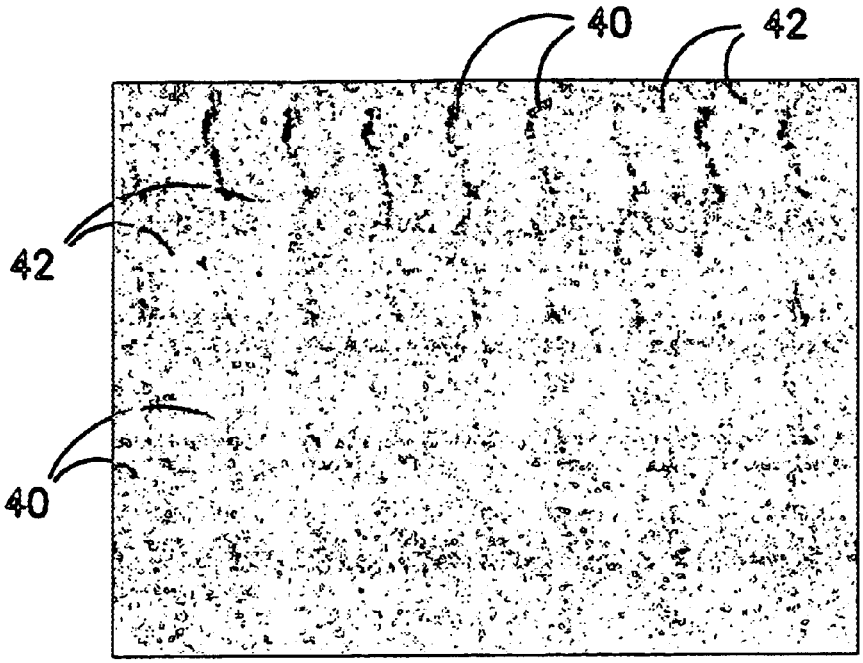
FIG. 5 is a view of the surface of an exemplary fabric formed in accordance with the present invention.

A Liba type stitch-bonding machine having a construction of similar to that illustrated in FIG. 1 was used to form an upholstery fabric. In the formation, a carded and cross lapped fleece substrate formed of 97% recycled polyester staple and about 3% core/sheath polyester bi-component staple including a low melting point polyester sheath constituent was passed to the stitch bonding machine. The fleece had a width of approximately 120 inches and a mass per unit area of approximately 90 grams per square meter. A polyester ground yarn of multi-filament construction having a linear density of approximately 70 denier was applied in a fully threaded chain stitch in substantially covering relation to the fleece. Concurrently with the stitching of the ground yarn, a multi-filament polyester pile yarn having a linear density of approximately 150 denier was applied in a selected patterned arrangement through the substrate. The pile yarn was threaded in a 3 inch repeat pattern through yarn guide elements which were shogged in a predefined sequence so as to impart a pattern of loop elements in a repeating stitch notation of 4-5, 4-3, 3-2, 3-4, 3-2, 2-1, 2-3, 2-1, 1-0, 1-2, 2-3, 2-1, 2-3, 3-4, 3-2, 3-4//. The resultant stitch bonded product was thereafter passed through an oven to activate the low melting point component of the bi-component fiber within the fleece and to enhance crimp and surface texture within the pile yarns. The resultant fabric is illustrated in FIG. 5.

EXAMPLE 2

Figure 6:
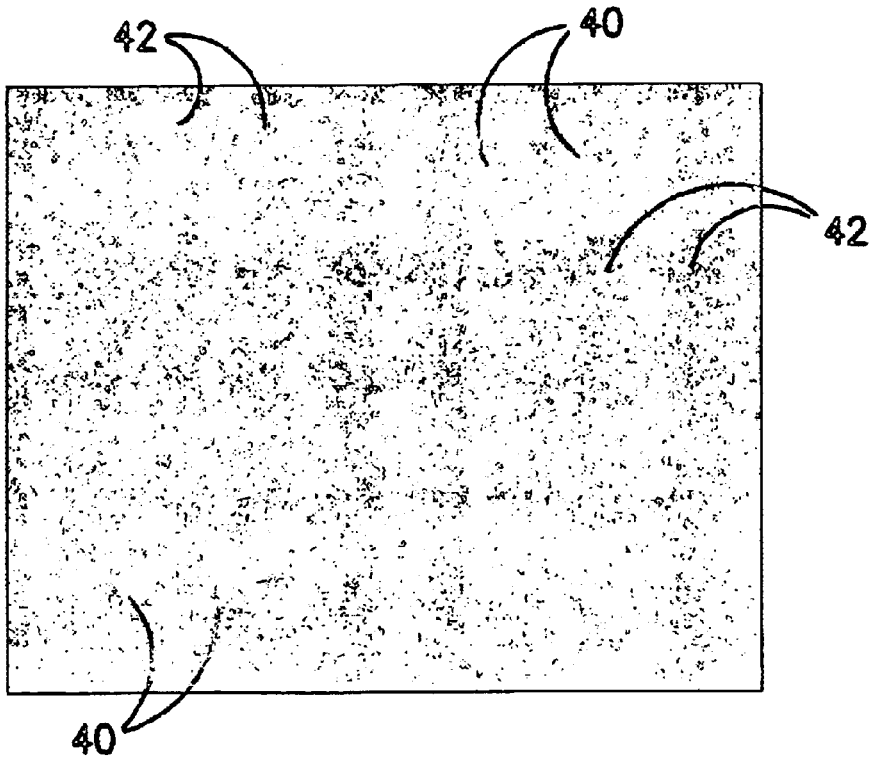
FIG. 6 is a view of the surface of another exemplary fabric formed in accordance with the present invention While the invention has been illustrated and will hereinafter be described in connection with certain exemplary embodiments and practices, it is to be understood that in no event is the invention to be limited to such illustrated and described embodiments and practices. On the contrary, it is intended that the present invention shall extend to all alternatives and modifications as may embrace the general principles of this invention within the full and true spirit and scope thereof.

The procedures of Example 1 were repeated in all respects except that the pile yarn was threaded through guide elements in a 5 inch repeat pattern and was selectively shogged to yield a stitch notation of 3-4, 3-2, 2-1, 1-0, 0-1, 1-0, 1-2, 3-3//. The resulting patterned pile fabric is illustrated in FIG. 6.

The present invention has now been described with reference to several embodiments thereof. However, it will be apparent to those skilled in the art that many changes can be made in the embodiments described without departing from the scope of the present invention. Thus, in no event is the scope of the present invention to be limited to the structures and practices described in this application. Rather, it is intended that the invention shall extend to all alternatives and equivalents embracing the broad principles of this invention within the full spirit and scope thereof.

What is claimed is:

1. A patterned fabric of stitch-bonded construction, the fabric comprising:

a substrate layer;

a plurality of ground yarns extending in stitched relation through the substrate layer so as to define a ground covering across the substrate layer; and a plurality of pile forming yarns extending in stitched relation through the substrate such that said pile forming yarns define a patterned arrangement of looped elements projecting away from the ground covering in predefined three dimensional patterned arrays disposed across the fabric.

2. The invention as recited in claim 1, wherein said substrate layer comprises a nonwoven fibrous material.

3. The invention as recited in claim 2, wherein said nonwoven fibrous material is selected from the group consisting of carded and cross lapped fleece, needle punched fleece and spun bonded fleece.

4. The invention as recited in claim 3, wherein said nonwoven fibrous material includes a first polymeric fibrous material characterized by a first melting point and at least a second polymeric fibrous material characterized by a second melting point which is lower than the first melting point and wherein the second polymeric fibrous material has been subjected to heat activation.

5. The invention as recited in claim 1, wherein said ground yarns are characterized by a linear which is less than the linear density of said pile forming yarns.

6. The invention as recited in claim 5, wherein said ground yarns are disposed through the substrate layer in a substantially continuous chain stitch arrangement.

7. The invention as recited in claim 1, wherein at least a portion of the patterned arrays of said looped elements are separated from one another by a plurality of substantially two dimensional loop-free segments disposed along the machine direction of the fabric.

8. The invention as recited in claim 1, wherein at least a portion of the patterned arrays of said looped elements are separated from one another by a plurality of substantially two dimensional loop-free segments disposed along the cross-machine direction of the fabric.

9. The invention as recited in claim 1, wherein at least a portion of the patterned arrays of said looped elements are separated from one another by a plurality of substantially two dimensional loop-free segments disposed along the machine direction of the fabric and by a plurality of substantially two dimensional loop-free segments disposed along the cross-machine direction of the fabric.

10. The invention as recited in claim 1, wherein at least a portion of the patterned arrays of said looped elements are characterized by boundary edges extending in angled substantially non-perpendicular relation to both the machine direction and the cross-machine direction of the fabric.

11. A patterned fabric of stitch-bonded construction, the fabric comprising:

a fibrous nonwoven substrate layer including a heat activated low melting point polymeric constituent;

a plurality of ground yarns characterized by a first linear density and extending in stitched relation through the substrate layer so as to define a ground covering across the substrate layer; and a plurality of pile forming yarns characterized by a second linear density greater than the first linear density and extending in stitched relation through the substrate layer such that said pile forming yarns define a patterned arrangement of looped elements projecting away from the ground covering in predefined three dimensional patterned arrays disposed across the fabric and wherein at least a portion of the patterned arrays of said looped elements are separated from one another by a plurality of substantially two dimensional loop-free segments disposed along at least one of the machine direction and the cross-machine direction of the fabric.

12. The invention as recited in claim 11, wherein at least a portion of the patterned arrays of said looped elements are separated from one another by a substantially two dimensional loop-free segments disposed along both the machine direction and the cross-machine direction of the fabric.

13. The invention as recited in claim 11, wherein at least a portion of the patterned arrays of said looped elements are characterized by boundary edges extending in angled substantially non-perpendicular relation to both the machine direction and the cross-machine direction of the fabric.

14. A method of forming a patterned fabric of stitch-bonded construction, the method comprising the steps of:

providing a substrate layer;

inserting a plurality of ground yarns in stitched relation through the substrate layer so as to define a ground covering across the substrate layer; and inserting a plurality of pile forming yarns in stitched relation through the substrate in a predefined pattern such that said pile forming yarns define a patterned arrangement of looped elements projecting away from the ground covering in predefined three dimensional patterned arrays disposed across the fabric.

15. The invention as recited in claim 14, wherein at least a portion of the ground yarns and at least a portion of the pile forming yarns are inserted though the substrate simultaneously using common reciprocating stitching needles.

16. The invention as recited in claim 14, wherein at least a first portion of the pile forming yarns are shogged laterally in a predefined manner from a first stitch line defined by a first pair of reciprocating stitching needles to at least a second stitch line defined by a second pair of reciprocating stitching needles so as to laterally shift formation of looped elements by said first portion of pile forming yarns between said first stitch line and said second stitch line.

17. The invention as recited in claim 16, wherein following the lateral shogging at least one of the reciprocating stitching needles of the first pair of reciprocating needles is free of threaded engagement by any of said pile forming yarns.

18. The invention as recited in claim 16, wherein following the lateral shogging at least one of the reciprocating stitching needles of the first pair of reciprocating needles is disposed in threaded engagment with a second portion of said pile forming yarns.

19. The invention as recited in claim 18, wherein following the lateral shogging at least one of the reciprocating stitching needles of the first pair of reciprocating needles inserts the second portion of said pile forming yarns in a flat stitched arrangement through the substrate layer.

20. The invention as recited in claim 14, wherein at least one sinker finger is selectively inserted and withdrawn between adjacent reciprocating needles during fabric formation such that looped elements are selectively formed between said reciprocating needles when said sinker finger is inserted and such that flat stitches are formed between said reciprocating needles when said sinker finger is withdrawn.

21. A method of forming a patterned fabric of stitch-bonded construction, the method comprising the steps of:

providing a substrate layer;

inserting a plurality of ground yarns in stitched relation through the substrate layer so as to define a ground covering across the substrate layer; and inserting a plurality of pile forming yarns in stitched relation through the substrate in a predefined pattern such that said pile forming yarns define a patterned arrangement of looped elements projecting away from the ground covering in predefined three dimensional patterned arrays disposed across the fabric wherein at least a portion of the patterned arrays of said looped elements are separated from one another by a plurality of substantially two dimensional loop-free segments disposed along at least one of the machine direction and the cross-machine direction of the fabric.

22. The invention as recited in claim 21, wherein at least a portion of the patterned arrays of said looped elements are separated from one another by a substantially two dimensional loop-free segments disposed along both the machine direction and the cross-machine direction of the fabric.

23. The invention as recited in claim 21, wherein at least a portion of the patterned arrays of said looped elements are characterized by boundary edges extending in angled substantially non-perpendicular relation to both the machine direction and the cross-machine direction of the fabric.

* * * * *